United States Patent [19]

La Bate

[11] 4,300,753

[45] Nov. 17, 1981

[54] HOT METAL RUNNER SYSTEM WITH AIR POLLUTION CONTROLS

[76] Inventor: Micheal D. La Bate, 115 Hazen Ave., Ellwood City, Pa. 16117

[21] Appl. No.: 133,356

[22] Filed: Mar. 24, 1980

Related U.S. Application Data

[63] Continuation-in-part of Ser. No. 123,369, Feb. 21, 1980, Pat. No. 4,262,885.

[51] Int. Cl.[3] ..... F27D 3/14

[52] U.S. Cl. ..... 266/196; 266/231

[58] Field of Search ..... 266/159, 231, 196

[56] References Cited

U.S. PATENT DOCUMENTS

| | | | |
|---|---|---|---|
| 2,409,741 | 10/1946 | Dobscha | 266/196 |
| 3,174,739 | 3/1965 | Miller | 266/196 |
| 3,365,187 | 1/1968 | French et al. | 266/196 |
| 3,863,907 | 2/1975 | Pierson, Sr. et al. | 266/196 |
| 4,108,051 | 8/1978 | Eakes | 266/159 |
| 4,216,708 | 8/1980 | Wyatt et al. | 266/196 X |

*Primary Examiner*—M. J. Andrews

*Attorney, Agent, or Firm*—Webster B. Harpman

[57] ABSTRACT

A runner for hot metal as from a blast furnace is formed of a series of interconnected modular units which are prefabricated, preferably from consumable, combustible and/or disintegratable materials of desired densities. A plurality of tunnel-like refractory lined covers are positioned continuously of the runner formed of the interconnected modular units so as to confine fumes, gas, smoke and other air pollutants. Vacuum devices are in communication with the covers so as to remove the air pollutants from the same and direct them through scrubbers and/or precipitron equipment to remove the air pollutants before the air entrained in the system is released to atmosphere.

5 Claims, 4 Drawing Figures

HOT METAL RUNNER SYSTEM WITH AIR POLLUTION CONTROLS

This application is a continuation in part of my copending patent application on PREFABRICATED CONSUMABLE BLAST FURNACE RUNNERS, Ser. No. 123,369, filed Feb. 21, 1980 now U.S. Pat. No. 4,262,885.

BACKGROUND OF THE INVENTION (1) Field of the Invention

This invention relates to hot metal runners as used in the metal producing industry for delivering molten metal from a source to a remote point and providing such hot metal runners with continuous enclosures and means for removing smoke, fumes, gases and the like therefrom to prevent air pollution.

(2) Description of the Prior Art

Runners for handling hot metal are disclosed in U.S. Pat. No. 2,409,741 and such runners generally comprised metal shapes with clay liners as will be understood by those skilled in the art.

U.S. Pat. No. 3,174,739 relates to a nose for a furnace tap hole runner and wherein the nose, like the runners with which it is used, comprises a metal shape having a refractory lining in the nature of a permanent monolithic layer.

U.S. Pat. No. 3,365,187 shows a runner system for a blast furnace.

The runners in general use at the time of the filing of U.S. Pat. No. 3,365,187 comprised clay shapes, some of which were carried in metal shapes and no runners are known in the art wherein a tunnel-like refractory lined cover formed of a series of modular units was provided to cooperate with the runners in forming a closed ferrous metal passageway so that the fumes, gasses, smoke and other air pollutants inherent in the pouring and running of ferrous metal can be removed and isolated from the atmosphere.

SUMMARY OF THE INVENTION

The present invention relates to a hot metal runner system for hot metal sources such as blast furnaces and open hearths, wherein the runners are arranged to provide a path for the fluid molten iron or steel from the furnace to a pouring point such as into a tundish in communication with a continuous casting machine or to a ladle for subsequent pouring into ingot molds or the like such molten iron or steel is usually at a temperature of about 3000° F.

By providing hot metal runners with tunnel-like covers continuously therealong and means for removing the hot gases, smoke, fumes and entrained air from the closed hot metal runner system at spaced intervals therealong, the air pollution commonly associates with hot metal pouring floors and the like can be almost completely eliminated as the fumes, smoke, gases and other air pollutants can be efficiently removed from the hot metal runner system disclosed herein and separated and confined by scrubbers and/or precipitron equipment so as to prevent atmosphereic air pollution.

DESCRIPTION OF THE PREFERRED EMBODIMENT

Figure 4:
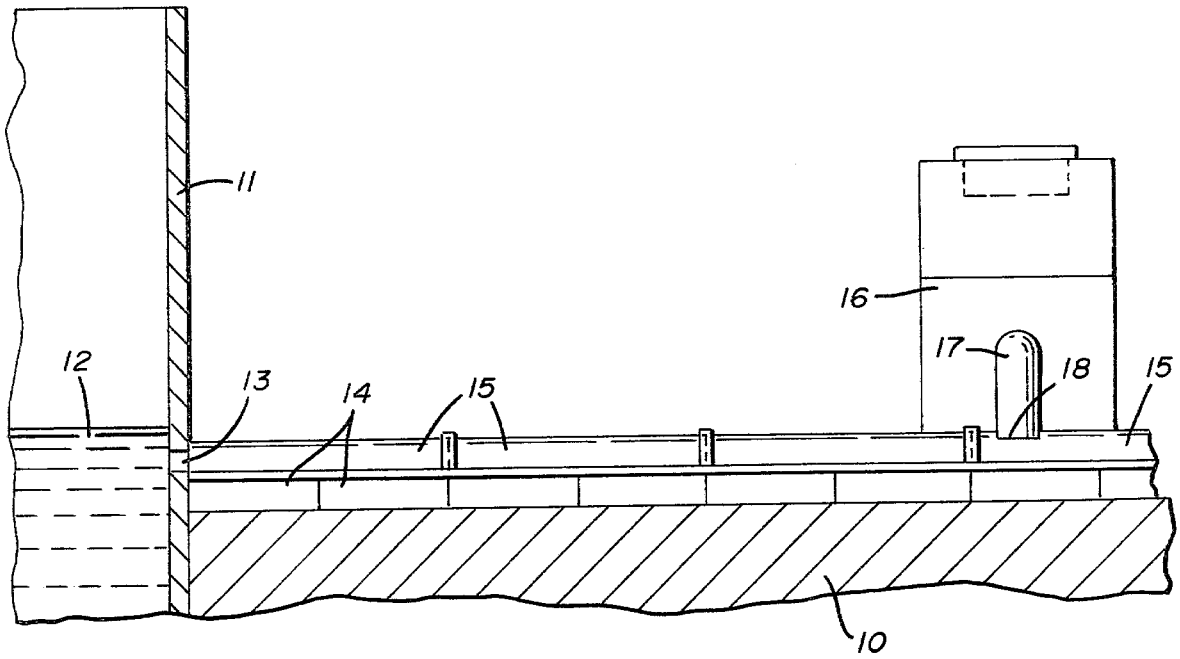
FIG. 4 is a symbolic side elevation of a source of hot metal, a runner system communicating therewith and with air pollution controls.

By referring to the drawings and FIG. 4 in particular, it will be seen that a pouring floor is generally indicated at 10 and is in association with a source of hot metal such as molten iron from a blast furnace 11. The tap hole 12 of the blast furnace or other hot metal source 11 and broken lines 12 in the furnace or other hot metal source indicate molten metal therein. A tap hole 13 in the hot metal source 11 is shown in communication with a hot metal runner system arranged on the floor 10 and comprising a plurality of hot metal runners 14 which are movable modular units preferably formed of consumable and/or disintegratable materials of desired densities which result in a calculated exposure life determination. The modular runner units 14 are preferably formed of a mixture including clay, wood chips, paper pulp, and/or any combustible material which when mixed or blended with any refractory material produces a consumable disintegratable combustible mixture that has a disintegration or combustion rate dictated by the density of the compaction of the material in the unit 14. Alternately, the runner units 14 may be formed of any refractory.

Still referring to FIG. 4 of the drawings, it will be seen that several tunnel-like refractory lined covers 15 are shown in position on the continuous row of runner units 14 so as to form a continuous enclosure with respect thereto and provide in effect a tunnel for the hot metal 12 flowing from the tap hole 13 and into the hot metal runner system.

An air moving device such as a vacuum machine 16 is illustrated in FIG. 4 of the drawings where it is in communication with a duct 17 which in turn communicates with an opening 18 in one of the tunnel-like refractory lined covers 15. Those skilled in the art will observe that more than one of the ducts 17 may be in communication with more than one of the openings 18 in the tunnel-like covers 15 if desired and depending upon the length of the hot metal runner system.

Preferably the device for removing fumes, smoke, dust, contaminated air and the like from the hot metal runner system is spaced with respect to both the hot metal source and the pouring end of the hot metal runner system so as to insure complete removal of air pollutants from the system.

Still referring to FIG. 4 of the drawings, those skilled in the art will understand that the air moving device 16 includes a blower and a driving means, such as an electric motor, and that it includes means for removing pollutants from the air directed therethrough. Such means may comprise scrubbers as known in the art or electrically actuated precipitation units, either of which will effectively remove smoke, gases, dust and other pollutants from an air stream moved therethrough and thus avoid atmospheric pollution.

Figure 1:
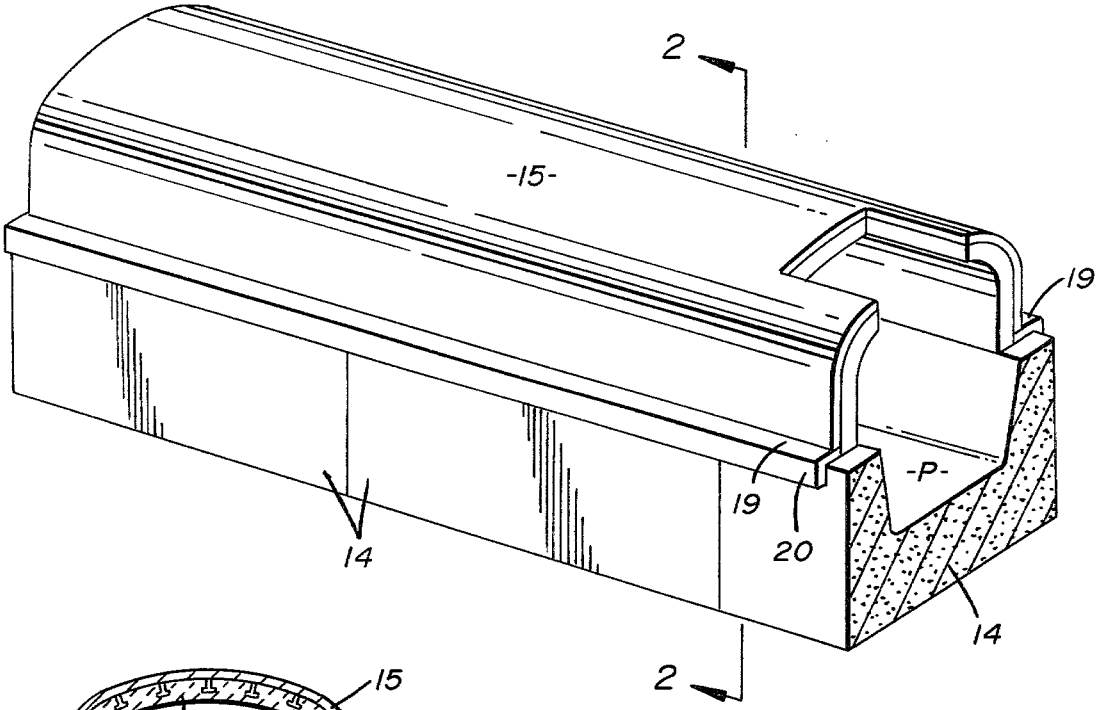
FIG. 1 is a perspective view of a portion of a hot metal runner system with air pollution control covers thereon.

By referring now to FIG. 1 of the drawings, it will be seen that the hot metal runner system shown in FIG. 4 is actually formed of a plurality of the modular units 14 in end to end alignment and it will occur to those skilled in the art that the end to end arrangement may have dove-tailed inter-engaging means not shown, such as shown in the parent application for patent hereinbefore referred to; Ser. No. 123,369.

Figure 2:
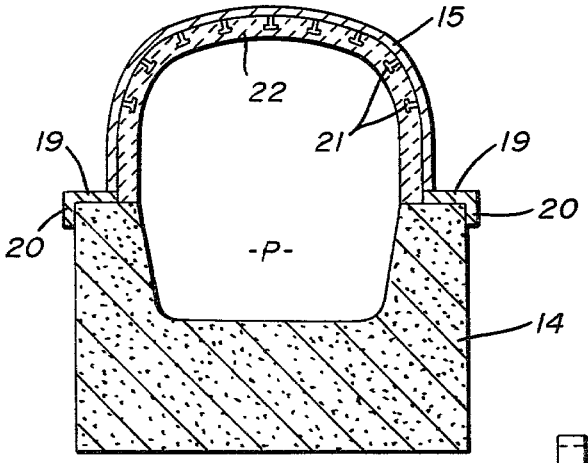
FIG. 2 is a vertical section on line 2—2 of FIG. 1.

In FIGS. 1 and 2 of the drawings, it will be seen that the tunnel-like refractory lined covers 15 are preferably shaped metal shells which are of inverted U-shape in cross section with the ends of the U provided with outturned and downturned flanges 19 and 20 respectively on each of the longitudinal edges of the tunnel-like refractory lined covers 15.

In FIG. 2 of the drawings, it will be seen that the configuration of the shaped metal parts which may be and preferably are sheet steel is such that the outturned flanges 19 and the downturned flanges 20 thereon register over the upper and immediate outer edges of the individual runners 14 which form the hot metal path P through which the hot metal 12 from the source of hot metal 11 flows to a pouring point as will be understood by those skilled in the art.

Still referring to FIG. 2 of the drawings, it will be seen that in a preferred form of the invention, the inner surface of the inverted U-shaped cover sections 15 are provided with a plurality of attached protruding metal shapes 21 which may resemble T-heads or nail heads and that a refractory lining 22 has been applied to the entire inner surface of the inverted U-shaped portion of the cover 15 and that the refractory layer 22 will thus be anchored to the cover 15.

Figure 3:
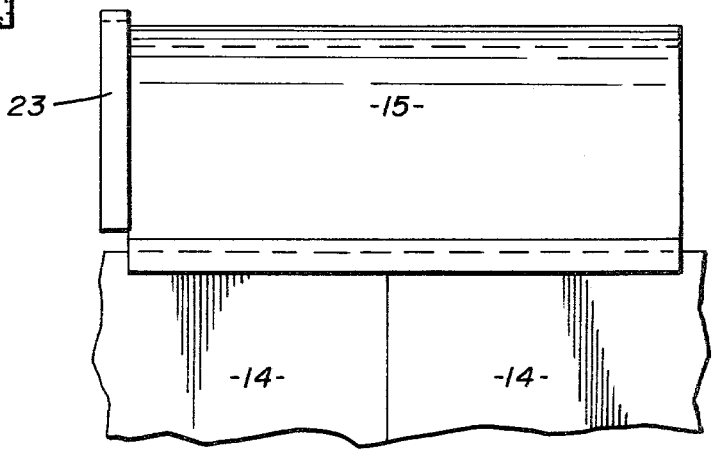
FIG. 3 is a side elevation of one of the tunnel-like refractory lined covers of FIG. 1 and portions of runners supporting the same.

In FIG. 3 of the drawings, one end of one of the covers 15 is illustrated as provided with an offset longitudinally extending flange 23 which is arranged to overlap the joint or end of the adjacent cover so as to improve the air tightness of the hot metal runner system disclosed herein.

In addition to the ability of the hot metal runner system to control air pollution on hot metal pouring floors and the like, it has been determined that the hot metal runner system disclosed herein provides an efficient heat insulating structure so that runners and tunnel-like cover assemblies deliver the molten metal with a very small loss of temperature and which action contributes to the rapid flow of the molten metal without any pooling or freezing as in common in the use of present refractory uncovered non-combustible and non-consumable runners and the like.

It will occur to those skilled in the art that various changes and modifications may be made in the invention disclosed herein without departing from the spirit thereof or from the scope of the appended claims and having thus described my invention what I claim is:

1. An improvement in a closed ferrous metal runner system for a hot metal pouring floor, said system extending from a source of molten metal to a pouring point thereof, the improvement comprising means for preventing air pollution of the pouring floor environment, said runner system comprising the combination of a plurality of elongated trough-like body members arranged in end to end relation, each of the body members having an integral base with spaced parallel upstanding side sections, said air pollution preventing means including a plurality of covers positioned in end to end relation on said plurality of trough-like body members connecting said source of molten metal and said pouring point, and means for securing said covers to said body members in an airtight manner to prevent fluid communication between said covered troughs and the environment surrounding said covered troughs, said body members and covers formed of material having a known life when subjected to molten ferrous metal flowing through said trough-like body members, said air pollution preventing means further including pollutant removal means connected to at least one of said covers.

2. The hot metal runner system set forth in claim 1 and wherein said covers are formed of steel and a refractory lining is positioned therein.

3. The hot metal runner system set forth in claim 2 and wherein said covers have inturned metal members on their inner surface and a refractory coating is positioned on said inner surfaces and engaged by said metal members.

4. The ferrous metal runner system set forth in claim 1 and wherein said trough-like body members are solid compacted shapes of a refractory and consumable and disintegratable material mixture.

5. The ferrous metal runner system set forth in claim 4 and wherein said refractory comprises clay and said consumable and disintegratable material comprises one or more such materials from a group including wood chips and paper pulp.

* * * * *